US007270099B2

(12) United States Patent
Dordet

(10) Patent No.: US 7,270,099 B2
(45) Date of Patent: Sep. 18, 2007

(54) PRESSURE GAUGE FOR COMBUSTION CHAMBER OF AN INTERNAL COMBUSTION ENGINE

(75) Inventor: Yves Dordet, Fonsorbes (FR)

(73) Assignee: Siemens VDO Automotive, Toulouse Cedex (FR)

( * ) Notice: Subject to any disclaimer, the term of this patent is extended or adjusted under 35 U.S.C. 154(b) by 0 days.

(21) Appl. No.: 10/542,047

(22) PCT Filed: Dec. 29, 2003

(86) PCT No.: PCT/EP03/14936

§ 371 (c)(1),
(2), (4) Date: Mar. 9, 2006

(87) PCT Pub. No.: WO2004/063631

PCT Pub. Date: Jul. 29, 2004

(65) Prior Publication Data

US 2006/0137655 A1 Jun. 29, 2006

(30) Foreign Application Priority Data

Jan. 14, 2003 (FR) ..... 03 00341

(51) Int. Cl.
*F23Q 7/22* (2006.01)

(52) U.S. Cl. ..... 123/142.5 E; 219/270

(58) Field of Classification Search ..... 123/142.5 E; 219/220

See application file for complete search history.

(56) References Cited

U.S. PATENT DOCUMENTS 6,138,654 A * 10/2000 Pretorius et al. ..... 123/642
6,411,038 B2 * 6/2002 Murai et al. ..... 123/435
6,979,801 B2 * 12/2005 Okazaki et al. ..... 219/270
2001/0015402 A1 * 8/2001 Murai et al. ..... 248/554
2004/0182144 A1 * 9/2004 Okazaki et al. ..... 73/118.1
2004/0182145 A1 * 9/2004 Okazaki et al. ..... 73/115

FOREIGN PATENT DOCUMENTS

| | | | |
|---|---|---|---|
| EP | 1 096 141 | | 5/2001 |
| JP | 59060237 | * | 6/1984 |
| JP | 07139736 | | 5/1995 |
| JP | 2002339793 | | 11/2002 |

* cited by examiner

*Primary Examiner*—Erick Solis
(74) *Attorney, Agent, or Firm*—Young & Thompson

(57) ABSTRACT

A glow plug (20) for an internal combustion engine (110) essentially includes:

a body (27) intended to be fixed to the engine, and a core (29) extending in a direction of elongation (11), connected to the body and intended to extend inside the combustion chamber (9) of the engine, measurement elements (200, 55, 65) intended to determine the pressure internal to the combustion chamber (9) through the displacement of the core (29) under the effect of pressure, characterized in that the glow plug is equipped with elements (50, 60) that make it possible to quantify the displacement of the core with respect to the cylinder head (5) of the engine on which the glow plug is installed.

13 Claims, 2 Drawing Sheets

PRESSURE GAUGE FOR COMBUSTION CHAMBER OF AN INTERNAL COMBUSTION ENGINE

CROSS REFERENCE TO RELATED APPLICATIONS

This is the 35 USC 371 national stage of international application PCT/EP2003/014936, filed on 29 Dec. 2003, which designated the United States of America.

FIELD OF THE INVENTION

The present invention relates to the control of internal combustion engines and more specifically to the measuring of the pressure in the combustion chamber of these engines.

BACKGROUND OF THE INVENTION

Internal combustion engines have "standard" settings established on test bed for controlling the injection of fuel according to the operating circumstances encountered. These settings do not unfortunately take account of the conditions of ageing of the engine in real time, particularly within the actual combustion chamber (fouling of the injectors, loss of compression, deterioration of the injector nozzle opening pressures, etc.).

Admittedly, it has been proposed for engines to be equipped with knock sensors. These sensors, of the accelerometer type, therefore allow the presence of shockwaves that carry the risk of damaging the engine to be detected, and avoided, by modifying the injection parameters. However, these sensors provide only a very imperfect solution to the improvement of engines to make them less polluting and/or more efficient.

This being the case, the applicant company has set itself the task, in order to optimise the operation of the engine, of measuring the pressure within the combustion chamber.

Various devices have already been proposed for measuring this pressure. However, these are either not very reliable or too expensive because of their cost price or because of the costs that they incur (modifying the cylinder head or the engine block in order to introduce a sensor).

SUMMARY OF THE INVENTION

The object of the present invention is to determine reliably and at a limited cost, the internal pressure in the combustion chamber.

To do this, the invention proposes a glow plug for an internal combustion engine essentially comprising a body intended to be fixed to the engine, and a core extending in a direction of elongation, the core being connected to the body and intended to extend inside the combustion chamber of the engine, and measurement means intended to determine the pressure internal to the combustion chamber through the displacement of the core under the effect of said pressure, this glow plug being equipped with means that make it possible to quantify the displacement of the core with respect to the cylinder head of the engine on which the glow plug is installed.

The pressure within the combustion chamber tends to drive the core out (push it back). In consequence, the invention makes it possible to deduce the pressure within the combustion chamber from the relative displacement of the core of the glow plug with respect to the cylinder head, without having to pierce the engine block, by incorporating the sensor into the glow plug.

According to an additional feature, the means intended to allow detection of the displacement of the core of the glow plug with respect to the cylinder head of the engine is a yoke secured to said cylinder head, either by screwing or by welding, or by any equivalent known means.

According to an advantageous feature of the invention, the measurement means are placed between said yoke and a part integral with the core, so as to incorporate the measurement system into the glow plug as best as possible.

According to an additional feature, the measurement means comprise a tubular piezoelectric element extending around the core in the direction of elongation between a first end and a second end, said tubular piezoelectric element being connected to the core at the first end and to the cylinder head via the yoke at the second end.

A piezoelectric element allows a displacement to be converted into a corresponding electrical signal with great precision for small-amplitude displacements, as in the case of the present invention (a few hundred nanometers). This solution proves to be all the more advantageous as piezoelectric elements work out to be less expensive than and are less sensitive to temperature than deformation sensors of the strain gauge type.

The invention also relates to a vehicle equipped with a propulsion unit comprising, in addition to the glow plug:

- an internal combustion engine having a combustion chamber and on which said glow plug is mounted,
- fuel-injection means for injecting fuel into the combustion chamber of the engine,
- processing means for processing the information acquired by the measurement means, said processing means controlling the injection means on the basis of the information acquired by the measurement means in the course of one combustion cycle.

This solution has the aforementioned advantages in relation to the glow plug.

Advantageously, the processing means comprise a high-frequency filter to eliminate information relating to the vibration of the core with respect to the cylinder head.

The displacement of the core with respect to the cylinder head depends in particular on the pressure in the combustion chamber, on the injection of fuel and on the combustion. By using a filter that cuts off frequencies appreciably higher than the rotational speed of the engine, for example, above 200 Hz, it is possible to reduce the effect of these disruptive influences on the measurement of pressure in the combustion chamber.

BRIEF DESCRIPTION OF THE DRAWINGS

The invention will emerge more clearly from the description which will follow, given the reference to the attached drawings in which.

DETAILED DESCRIPTION OF THE INVENTION

Figure 1:
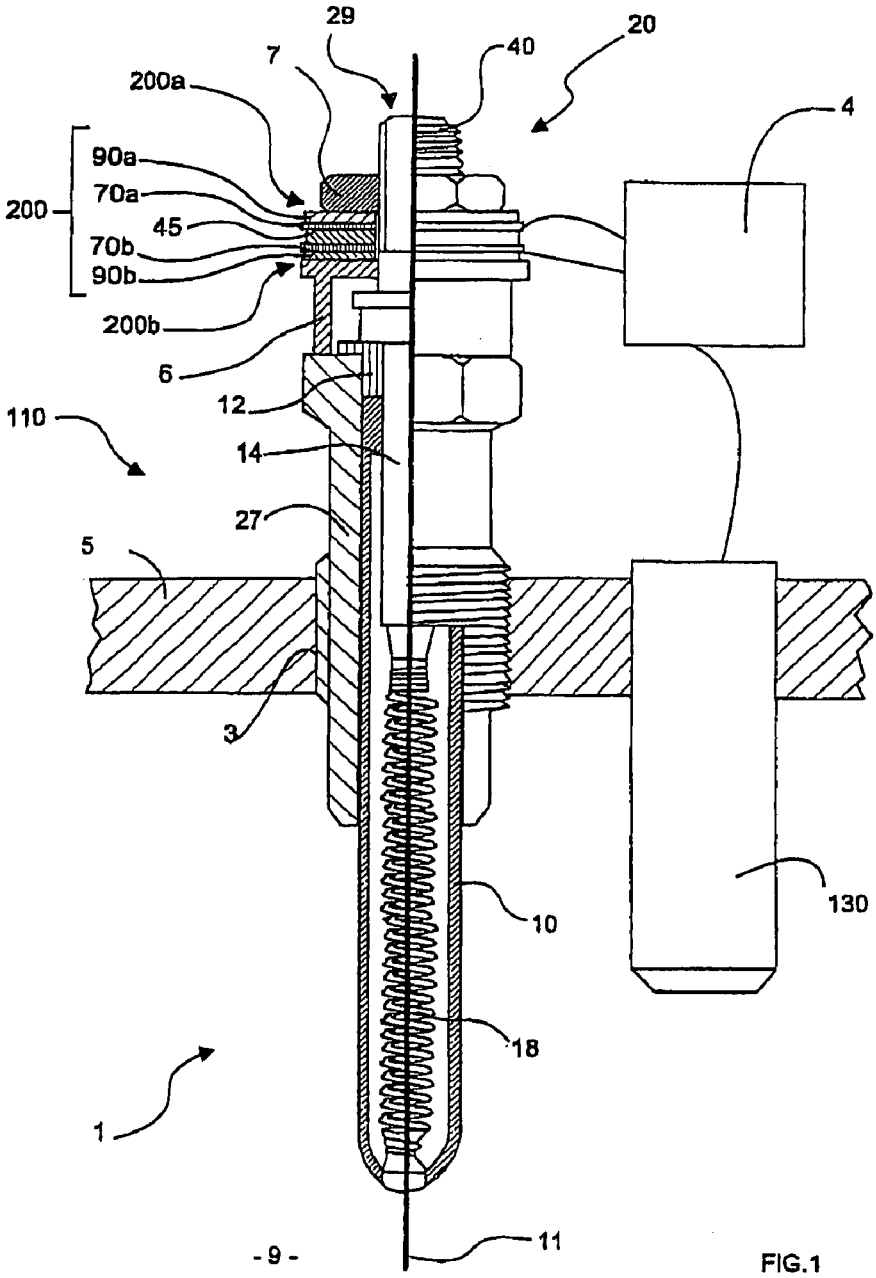
FIG.1 PRIOR ART
FIG. 1 illustrates, in part section, a glow plug of the prior art mounted on a cylinder head of an internal combustion engine.

FIG. 1 illustrates a propulsion unit 1 comprising a glow plug 20, fuel-injection means 130, an electronic computer 4 and an engine block 110 of an internal combustion engine comprising, in particular, a cylinder head 5 and a combustion chamber 9.

The glow plug 20 here consists of a glow plug for a diesel engine extending in a direction of elongation 11 and housed in an orifice 3 made for that purpose in the cylinder head 5. In accordance with conventional glow plugs, the glow plug 20 comprises a body 27, a core 29 extending inside the body and an insulating sealing collar 12 arranged between the body 27 and the core 29, generally consisting of an elastomer seal.

The core 29 comprises a resistive electric element 18 protected by a sheath 10 extending into the combustion chamber 9, and a rod 14 secured to the sheath 10 and connecting the resistive element 18 to a threaded current lead-in 40 to which the power supply to the resistive element 18 is connected.

The glow plug 20 is also equipped with a displacement sensor 200 consisting of a sensitive piezoceramic element 45 placed between two contact rings 70*a* and 70*b* and electrically insulated from the core 29 and from the body 27 by two insulating rings 90*a*, 90*b*.

The sensitive element 45, the contact rings 70*a*, 70*b* and the insulating rings 90*a*, 90*b* are tubular, which means that the current lead-in 40 and the rod 14 pass through them and are locally surrounded by them.

The sensor 200 is connected, at a first end 200*a* in the direction of elongation 11, to the core 29 by means of a fixing nut 7 and at the other end 200*b* in the direction of elongation 11 to the body 27 by a spacer piece 6 resting against this body 27, said insulating rings 90*a*, 90*b* being interposed, in the case of one of them, between the contact ring 70*a* and the nut 7, and, in case of the other, between the contact ring 70*b* and the spacer piece 6.

The computer 4 is electrically connected to the contact rings 70*a*, 70*b* between which it measures the difference in voltage on the one hand, and to the injection means 130, so as to control the amount of fuel injected into the combustion chamber 9 and the instant at which it is injected, on the other hand.

During internal combustion, the pressure in the combustion chamber 9 increases and the glow plug 20 is subjected to this. This pressure has a tendency to "drive" the glow plug outwards. The core 29 and in particular the sheath 10, although held in position with respect to the body 27, move slightly by a few microns with respect to said body 27, which for its part is secured to the cylinder head 5, according to the pressure inside the combustion chamber.

These miniscule displacements do not endanger the integrity of the glow plug 20 and make it possible to deduce the pressure in the combustion chamber 9. Specifically, the variation in the relative position of the core 29 with respect to the body 27 in the direction of elongation 11 modifies the pressure exerted on the piezoelectric element 45, and this induces a potential difference across the contact rings 70*a*, 70*b*.

The information relating to the potential difference in the course of one combustion cycle across the contact rings 70*a*, 70*b* is processed by the computer 4 which, by reference to an operating model already saved in memory, determines the injection of fuel in real time, making it possible to take account of the state of the engine whatever its operating history.

The computer 4 comprises signal processing means for eliminating parasitic information. In particular, the computer comprises a high-frequency filter to eliminate the variations in voltage between the contact rings 70*a*, 70*b* that relate to vibrations of the core with respect to the body and the frequency of which is above 200 hertz for example.

Figure 2:
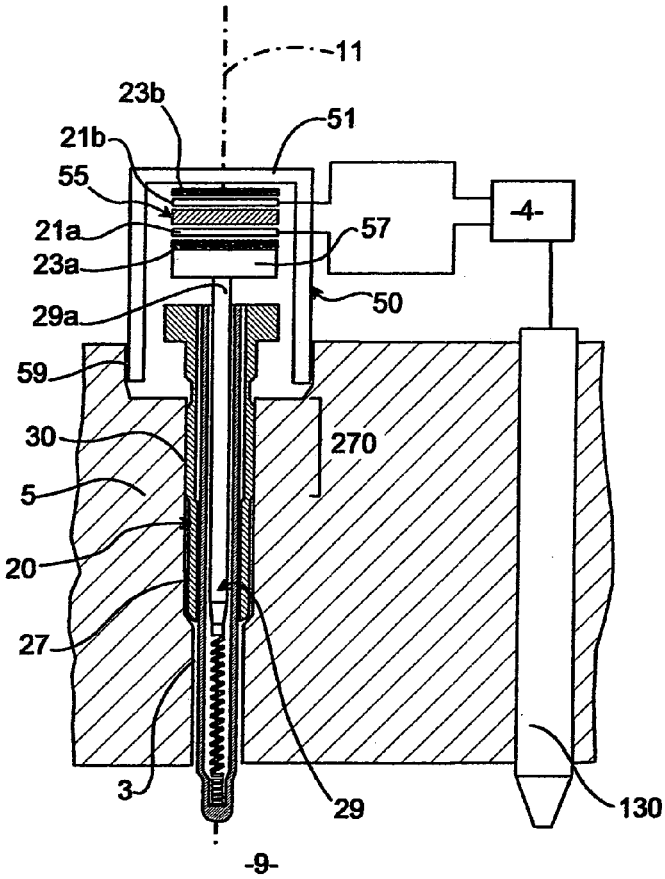
FIGS. 2 and 3 show two variants, on a different scale, of the mounting of a glow plug on a cylinder head.

A preferred embodiment is depicted in FIG. 2. Once again, we have the glow plug 20 of FIG. 1, the outer body 27 of which is threaded over its portion labeled 270 and engages directly in the tapping 30 of the orifice 3 in a direction of elongation and of mounting 11.

The spacer piece 6 here is replaced by a stirrup-shaped yoke 50 projecting at the rear of the cylinder head 5 to serve, via its transverse wall 51, as a bearing surface, the position of which is fixed with respect to the cylinder head for the pressure/displacement sensor 55. This yoke 50, added to the glow plug 20 of the prior art, is secured to the cylinder head 5 and makes it possible to make a mechanical connection between the latter and the glow plug 20, on the one hand, and to exert pressure on the displacement sensor 55 via its transverse wall 51 once mounting has been achieved, on the other hand.

The rear end 29*a* of the central core 29 has, beyond the body 27, at the opposite axial end to the combustion chamber 9 (and therefore in the direction of elongation 11), a bearing surface 57 for the sensor 55, which sensor is therefore interposed between the surfaces 51 and 57, so that the variations in pressure in the chamber 9 are transmitted to the core 29 and therefore to the sensor 55 via the surface 57, the yoke 50 being fixed with respect to the cylinder head 5.

It should be noted that, in this embodiment, the yoke 50 makes it possible to dispense with the nut 7 depicted in FIG. 1.

Furthermore, in this embodiment, the sensor 55 is pressurised by the increase in pressure in the chamber 9 whereas in the embodiment of FIG. 1, the increase in pressure in the chamber 9 will cause a relaxation of the measurement sequence.

Although the body 27 of the glow plug 20 is screwed, and therefore fixed, to the cylinder head 5, the yoke 50 provides a direct mechanical connection between the cylinder head and the central core 29, so as to get around the problem of any play there might be between the body 27 screwed to the cylinder head. By eliminating this play in this way, the sensor 55 is more capable of determining the pressure in the chamber 9.

Furthermore, and contrary to FIG. 1, the yoke 50 makes it possible to eliminate from the measurement any vibration that the glow plug 20 may exhibit with respect to the cylinder head 5, because the relative movement is, in this instance, evaluated directly between the cylinder head and the core 29 of the glow plug 20 rather than between the core 29 and the body 27.

Although the yoke 50 has been depicted in the manner of a bell-shaped stirrup, here with an inverted U-shaped cross section, other shapes could have been anticipated.

Likewise, a connection other than by screwing (at 59) between the yoke and the cylinder head 5 could be anticipated (a bayonet system for example, or even welding if these fixing means can allow the "reference" pressure exerted on the sensor 55 in the direction of elongation 11 to be modified).

In theory, the yoke 50 could be welded, or even manufactured directly as an integral part of the cylinder head 5 (for example by casting).

This figure again shows the computer 4 which, on the basis of the potential difference measured across the terminals of the contact rings 21*a* and 21*b* allows the fuel-injection means 130 to be controlled. As in FIG. 1, the contact rings 21*a* and 21*b* are insulated from the remainder of the installation by the insulating rings 23*a* and 23*b*.

Figure 3:
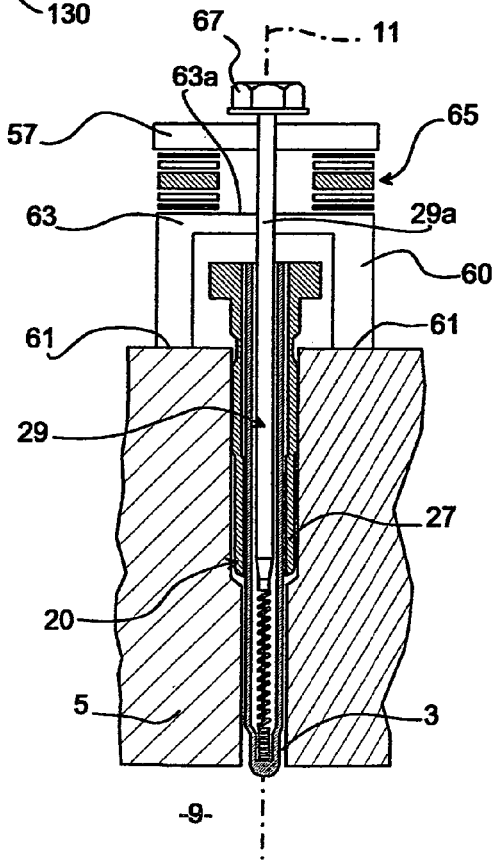

In FIG. 3, the body 27 of the glow plug 20 is once again screwed into the threaded orifice 3 of the cylinder head 5 and the rear part 29*a* of the central core 29 is connected to the transverse bearing bar 57.

However, in this version, the transverse bar 57 is placed above the yoke 60, which is fixed (for example by welding at 61) with respect to the cylinder head).

The transverse wall 63 of the yoke extends at right angles to the direction of elongation 11 so as to exhibit a fixed bearing surface 63*a*, for the pressure sensor 65, which sensor is interposed between the yoke (transverse wall 63) and the bearing bar 57, subjected to the pressure of the nut 67 which therefore pulls on the core 29 in the direction 11 in order to exert an appropriate reference pressure on the sensor.

Of course, the invention is not in any way restricted to the embodiment which has just been described by way of nonlimiting example. Thus, it could be anticipated for the invention to be applied to other types of internal combustion engine, such as a controlled-ignition engine, particularly a gasoline engine. As a controlled-ignition engine plug also comprises a body intended to be fixed to a cylinder head and a core extending inside the body (between which items a spark is generated), measurement means according to the invention may be placed between the body and the core to measure their relative displacement.

As a variant (not depicted), the spacer piece 6 may be omitted if the configuration of the plug 20 lends itself to direct mounting of the sensor 200 on the body 27 of the plug.

The invention claimed is:

1. A glow plug (20) for an internal combustion engine (110) essentially comprising:

a body (27) intended to be fixed to the engine, and a core (29) extending in a direction of elongation (11), connected to the body and intended to extend inside the combustion chamber (9) of the engine, measurement means (200, 55, 65) adapted to determine the pressure internal to the combustion chamber (9) through the displacement of the core (29) under the effect of said pressure, and means (50, 60) to measure the movement of the core with respect to the cylinder head (5) of the engine on which the glow plug is installed.

2. The glow plug as claimed in claim 1, characterized in that the means (50, 60) to measure the movement of the core with respect to the cylinder head are yokes secured to the cylinder head (5) at one of their ends.

3. The glow plug as claimed in claim 2, characterized in that yoke (50, 60) is screwed to the cylinder head (5).

4. The glow plug as claimed in claim 2, characterized in that the yoke (50, 60) is welded to the cylinder head (5).

5. The glow plug as claimed in claim 1, characterized in that the measurement means (200, 55, 65) are placed between the yoke (50, 60) on the one hand, and a part (57) integral with the core (29) of said glow plug (20).

6. The glow plug as claimed in claim 1, characterized in that the measurement means (200, 55, 65) comprise at least one tubular piezoelectric element (45) extending around the core in the direction of elongation between a first end and a second end, said tubular piezoelectric element being connected to the core at the first end (200*a*) and to the cylinder head (5) via a yoke (50, 60) at the second end (200*b*).

7. A vehicle equipped with a propulsion unit (1) comprising:

a glow plug (20) as claimed in claim 1, an internal combustion engine (110) having a combustion chamber (9) and on which said glow plug is mounted, fuel-injection means (130) for injecting fuel into the combustion chamber of the engine, processing means (4) for processing the information acquired by the measurement means, in which the processing means (4) control the injection means (130) on the basis of the information acquired by the measurement means (200, 55, 65) in the course of one combustion cycle.

8. The vehicle as claimed in claim 7, characterized in that the processing means (4) comprise a high-frequency filter to eliminate information relating to the vibration of the core with respect to the cylinder head.

9. The vehicle as claimed in claim 7, characterized in that the processing means compare the information transmitted by the measurement means in the course of one cycle with reference values and control the injection means on the basis of this comparison.

10. The vehicle as claimed in claim 7, characterized in that it comprises an engine of the diesel type.

11. The vehicle as claimed in claim 8, characterized in that the processing means compare the information transmitted by the measurement means in the course of one cycle with reference values and control the injection means on the basis of this comparison.

12. The vehicle as claimed in claim 8, characterized in that it comprises an engine of the diesel type.

13. The vehicle as claimed in claim 9, characterized in that it comprises an engine of the diesel type.

* * * * *